US005621951A

United States Patent [19]

Gould

[11] Patent Number: 5,621,951

[45] Date of Patent: Apr. 22, 1997

[54] DEVICE FOR COVERING AND CONCEALING BUTTONS

[76] Inventor: John C. Gould, 3320 Glencairn Ct., Unit 101, Bonita Springs, Fla. 33923

[21] Appl. No.: 664,670

[22] Filed: Jun. 17, 1996

[51] Int. Cl.[6] ..... A44C 13/00; A44B 1/16

[52] U.S. Cl. ..... 24/90.5; 24/113 MP; 24/113 R

[58] Field of Search ..... 24/90.5, 113 R, 24/113 MP

[56] References Cited

U.S. PATENT DOCUMENTS

| | | | |
|---|---|---|---|
| 3,543,354 | 12/1970 | Schuchman, Sr. et al. | 24/90.5 X |
| 3,934,313 | 1/1976 | Hocq | 24/90.5 X |
| 4,918,791 | 4/1990 | Hardin | 24/90.5 |
| 5,060,356 | 10/1991 | Szedzinski | 24/113 R |
| 5,161,285 | 11/1992 | Jerjian | 24/90.5 X |
| 5,337,584 | 8/1994 | Angeli | 24/113 R X |
| 5,394,719 | 3/1995 | Fang | 24/113 MP X |

*Primary Examiner*—Peter M. Cuomo
*Assistant Examiner*—Robert J. Sandy

[57] ABSTRACT

A plastic device for detachably covering and concealing a button employs a first horizontal plate having at least one opening therein. A second horizontal plate spaced from the first plate is secured to one end of a hollow cylinder having opposite open ends and closes same. A living hinge integrally secures a portion of the periphery of the other open end of the cylinder to a peripheral portion of the first plate. The device has an open position at which the other end of the cylinder is out of engagement with the first plate and has a closed position at which said other end of the cylinder is in mating engagement with the first plate. The cylinder and the first plate are provided with detachable locking engagement means which are spaced apart when the device is in the open position and which are disposed in locking engagement when the device is in closed position.

3 Claims, 1 Drawing Sheet

DEVICE FOR COVERING AND CONCEALING BUTTONS

BACKGROUND OF THE INVENTION

One type of cover for detachably covering and concealing buttons attached to shirts, blouses and the like is well known in the at as shown for example in U.S. Pat No. 5,161,285. Typically, such covers have a closure plate having an opening so constructed that the plate can be slid between the button and the shirt with the button fastening threads extending through the opening. A separate cap is placed over the plate and engages it at right angles to seal off the button. A hinge connects the cap and covert The hinge can be a separate element o can be secured to the plate. The plate and cap are separate elements.

The present invention is directed to a device which can be used as a new type of button cover. This device is formed entirely of plastic with a cap and a cover being integrally connected by a living hinge. Such a plastic structure is much less expensive than known covers. However, this structure as thus far described has been found to be unsatisfactory since the cover and cap lacked sufficient structural strength for secure engagement, whereby the structure would tend to become loose and not function properly.

This problem of insufficient structural strength for secure engagement has been overcome in the present invention by incorporating cooperating detachable securing means into the device, whereby secure detachable engagement is automatically obtained.

SUMMARY OF THE INVENTION

Accordingly, it is an object of the present invention to provide a new and improved device for use as a button cover.

An other object is to provide a new and improved device of the character indicated that is formed entirely of plastic and which incorporates cooperating detachable securing means for obtaining secure detachable engagement.

These and other objects and advantages of the invention will either be explained or will become apparent hereinafter.

In accordance with the principles of this invention, a device for detachably covering and concealing a button is composed entirely of plastic. The device employs a first horizontal plate having at least one opening therein as well as a hollow cylinder having opposite open ends. A second horizontal plate is spaced from the first plate, the second plate being secured to one end of the cylinder and closing same. A living hinge integrally secures a portion of the periphery of the other open end of the cylinder to a peripheral portion of the first plate.

The device has an open position at which said other end of the cylinder is out of engagement with the first plate and having a closed position at which said other end of the cylinder is in mating engagement with the first plate. The cylinder and the first plate are provided with detachable locking engagement means which are spaced apart when the device is in the open position and which are disposed in locking engagement when the device is in closed position. These cooperating detachable securing means are incorporated into the device in order to obtain secure detachable engagement.

DETAILED DESCRIPTION OF PREFERRED EMBODIMENTS

Figure 6:
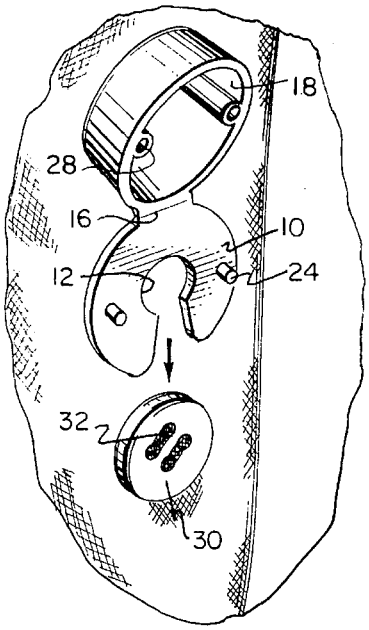
FIG. 6 showns the embodiment as shown in FIG. 1 in position to engage a button.

Referring now to FIGS. 1–5, the device shown is used for covering and concealing a button and is composed entirely of plastic.

The device utilizes a first horizontal circular plate 10 having at least one opening therein. The opening includes a central circular region 12 connected by a slot 14 having the shape of a trapezoid to the periphery, the larger base of the slot 14 defining an opening in the periphery of the plate. A peripheral portion of plate 10 is secured by a living hinge 16 to a peripheral portion of one open end 18 of a hollow circular cylinder 20. The opposite open end of the cylinder is closed by a second horizontal circular plate 22.

The device has an open position at which the open end 18 of the cylinder is out of engagement with the first plate and has a closed position at which said other end of the cylinder is in mating engagement with the first plate. In order to provide suitable secure detachable engagement, the cylinder and the first plate are provided with detachable locking engagement means which are spaced apart when the device is in the open position and which are disposed in locking engagement when the device is in closed position.

To this end, the plate 10 is provided with first and second equidistantly spaced prongs 24 which extend upward at right angles to the plate and the cylinder is provided with first and second equidistantly spaced tubes 26 which are parallel to the axis of the cylinder and are secured to the inner surface of the cylinder. Each tube has one end essentially coincident with the end 18, this coincident tube end having a prong receiving recess 28 adapted to receive and contain a corresponding prong. Once prongs and recesses are in locking engagement, the plate 18 must be pulled away from the cylinder in order to disengage the prongs from the recesses.

Figure 7:
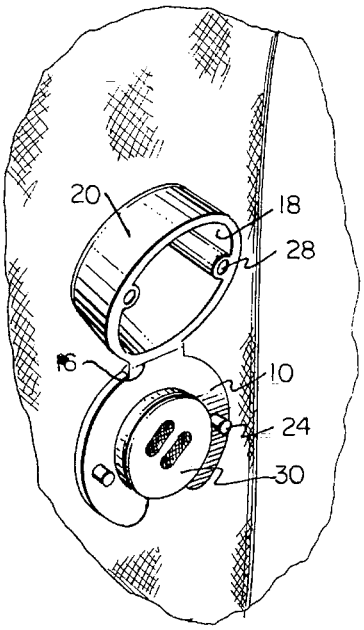
FIG. 7 shows the embodiment as shown in FIG. 1 in open position and engaging this button.
Figure 8:
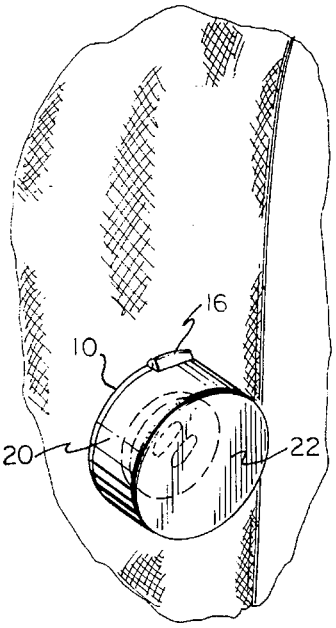
FIG. 8 shows the embodiment as shown in FIG. 5 in closed position and engaging this button.
Figure 1:
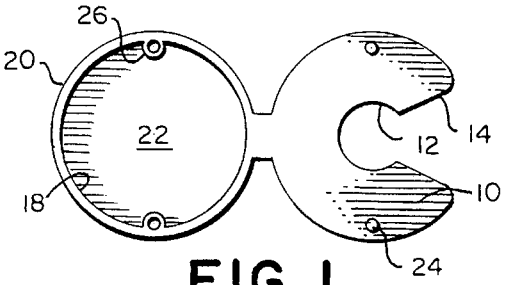
FIG. 1 is a top plan view of a first embodiment of the invention as shown in open position.
Figure 4:
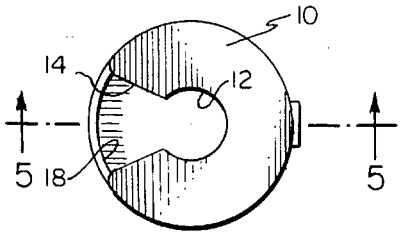
FIG. 4 is a bottom plan view of the embodiment as shown in closed position.
Figure 2:
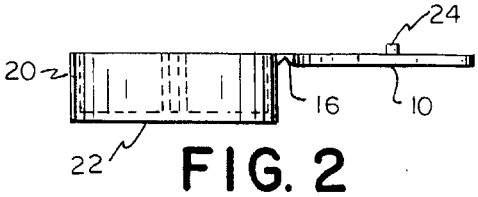
FIG. 2 is a side view of the embodiment as shown in FIG. 1.
Figure 5:
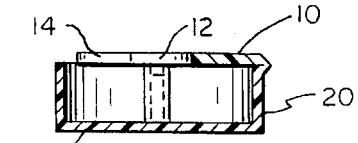
FIG. 5 is a view taken along line 5—5 in FIG. 4.
Figure 3:
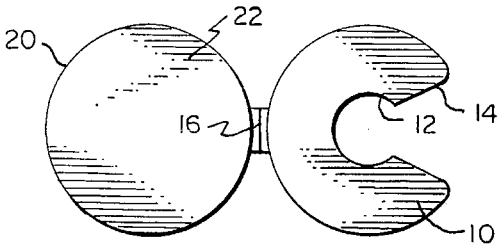
FIG. 3 is a bottom plan view of the embodiment as shown in FIG. 1.

FIGS. 6–8 illustrate the use of the device. With the device in open position, the plate 10 is slid behind a button 30 with its securing threads 32 sliding into the opening in the plate 10. Once plate 10 is disposed in proper position, the cylinder is swung downward until the prongs and recesses are engaged, thus concealing the button. The process can be reversed as desired to remove the device from the button without any damage to button or device.

While the invention has been described with particular reference to the preferred embodiment and to the drawings, the protection sought is to be limited only by the terms of the claims which follow.

What is claimed is:

1. A device for detachably covering and concealing a button having a thread secured thereto, said device being composed entirely of plastic and comprising:

a first horizontal plate having at least one opening therein, the opening defining a slot through which said thread can extend, the first plate being disposed behind the button with the thread extending throught the slot when the device is in use;

a hollow cylinder having opposite open ends;

a second horizontal plate spaced from the first plate, the second plate being secured to one end of the cylinder and closing same;

a living hinge integrally securing a portion of the periphery of the other open end of the cylinder to a peripheral portion of the first plate;

said device having an open position at which said other end of the cylinder is out of engagement with the first plate and having a closed position at which said other end of the cylinder is in mating engagement with the first plate, said cylinder and said first plate provided with detachable locking engagement means which are spaced apart when the device is in the open position and which are disposed in locking engagement when the device is in closed position, the button being concealed when the device is in closed position.

2. A device for detachably covering and concealing a button having a thread secured thereto, said device being composed entirely of plastic and comprising:

a first horizontal plate having at least one opening in the form of a slot through which said thread can extend, the first plate being disposed behind the button with the thread extending throught the slot when the device is in use;

a hollow cylinder having opposite open ends;

a second horizontal plate spaced from the first plate, the second plate being secured to one end of the cylinder and closing same;

a living hinge integrally securing a portion of the periphery of the other open end of the cylinder to a peripheral portion of the first plate;

at least one prong secured to the first plate and extending at right angles thereto;

at least one tube secured to the inner surface of the cylinder and extending parallel to its axis with one tube end being essentially coincident with the other end of the cylinder and having an opening which defines a prong receiving recess;

said device having an open position at which said other end of the cylinder is out of engagement with the first plate and having a closed position at which said other end of the cylinder is in mating engagement with the first plate, said prong and said prong receiving recess defining detachable locking engagement means which are spaced apart when the device is in the open position and which are disposed in locking engagement when the device is in closed position, the button being concealed when the device is in closed position.

3. The device of claim 2 wherein the first plate has two equidistantly spaced prongs which extend at right angles to the plane of the plate, and the cylinder has two equidistantly spaced tubes parallel to the axis of the cylinder which are secured to the inside surface of the cylinder with one end of each tube being essentially coincident with the other end of the cylinder, said one end of each tube defining a separate prong receiving recess for detachably receiving a corresponding one of said prongs, said prongs and said tubes defining said detachable locking means.

* * * * *